United States Patent [19]

McKechnie

[11] 4,395,999

[45] Aug. 2, 1983

[54] ELECTRONIC IGNITION SYSTEM

[76] Inventor: Ian C. McKechnie, 252-27 E. Tropicana, Las Vegas, Nev. 89109

[21] Appl. No.: 789,014

[22] Filed: Apr. 20, 1977

[51] Int. Cl.[3] ..... F02P 3/04

[52] U.S. Cl. ..... 123/618; 123/146.5 A; 123/634; 123/644; 123/655

[58] Field of Search ..... 123/117 R, 148 E, 618, 123/634, 644, 655, 146.5; 315/209 T

[56] References Cited

U.S. PATENT DOCUMENTS

| | | | |
|---|---|---|---|
| 3,237,620 | 3/1966 | Hetzler et al. | 123/148 E |
| 3,238,416 | 3/1966 | Huntzinger et al. | 123/148 E |
| 3,322,107 | 5/1967 | Mieras et al. | 123/148 E |
| 3,749,073 | 7/1973 | Asplund | 123/117 R |
| 3,824,977 | 7/1974 | Campbell et al. | 123/148 E |
| 3,910,243 | 10/1975 | Gav et al. | 123/148 E |
| 3,937,193 | 2/1976 | Kim | 123/117 R |
| 3,938,490 | 2/1976 | Snyder et al. | 123/148 E |
| 3,945,362 | 3/1976 | Neuman et al. | 123/148 E |
| 3,990,417 | 10/1976 | Tershak | 123/148 E |
| 4,008,698 | 2/1977 | Gartner | 123/148 E |
| 4,018,202 | 4/1977 | Gartner | 123/148 E |

*Primary Examiner*—Sal Cangialosi

[57] ABSTRACT

A solid state inductive ignition system for igniting the mixture in the cylinders of an associated engine with a spark of up to 48 to 50 KV occurring at the most desirable position of the pistons for maximum mileage and power with a minimum of undesirable exhaust emissions. Exceptionally wide spark plug gaps are used to aid in igniting extra lean mixtures. The invention includes a novel high voltage spark distribution system utilizing, if desired, a conventional diameter distribution cap while providing sufficient clearance between adjacent spark plug cable outlets to prevent crossfire. Multiple sparks are provided while cranking to insure the ignition of overly rich or lean mixtures and a constant dwell of extremely short duration is used when running to saturate the core of the ignition coil.

5 Claims, 9 Drawing Figures

ELECTRONIC IGNITION SYSTEM

BACKGROUND OF THE INVENTION

The present invention and improvement over co-pending applications, Ser. No. 654,299 filed Feb. 2, 1976 and Ser. No. 790,890 filed May 28, 1976 of the same inventor, provides further simplified and improved circuitry for selectively positioning the spark. The inventor further provides an improved ignition coil design having a short constant time dwell providing secondary voltage of 48 to 50 KV from a 12 volt system over a potential operating range of from idle to 12,000 RPM of an 8 cylinder engine while providing approximately 20 engine degrees of electronic spark advance.

Most ignition systems of the inductive type use a constant angle of rotation to provide dwell. As a result, at slow speeds, excessive current is used with resultant heating, while at speeds in excess of 2,500 RPM, there is insufficient dwell time to saturate the ignition coil core so that the secondary output voltage drops off appreciably.

U.S. Pat. Nos. 3,937,193 and 3,938,490 disclose methods providing limited periods of constant dwell time but still draw excessive current at low speeds and provide low secondary voltage at high speeds.

A multitude of other patents have issued which disclose various methods of providing solid state spark position circuitry but none of them use the alternating voltage generated directly by a magnetic pickup coil to provide a method of positioning the spark.

The Chrysler Corporation is currently building a spark positioning system based on U.S. Pat. Nos. 3,885,534 and 3,910,243 where the magnetic pickup signal is converted to a sawtooth pulse which is then utilized to provide spark advance. No attempt has been made to provide a constant dwell.

In accordance with the invention disclosed, a novel high-voltage distribution system is provided using a conventional diameter distributor cap of $3\frac{7}{8}$ inches for an 8 cylinder engine capable of distributing sparks in excess of 40 KV to the spark plugs while using full electronic spark advance. Delco Remy found it necessary to increase the diameter of the distributor cap on current distributors for 8 cylinder engines, to $5\frac{3}{8}$ inches when providing voltages of up to 35 KV with mechanical spark advance. In Applicant's co-pending application, Ser. No. 654,299, filed Feb. 2, 1976, a method of distributing spark voltages in excess of 40 KV is disclosed while providing full electronic advance using a novel rotor responsive to speed in a distributor cap diameter of $5\frac{3}{8}$ inches.

SUMMARY OF THE INVENTION

The present invention discloses a method and means for providing a constant dwell time for saturating the ignition coil core throughout the speed range of the engine while reducing the dwell time to as low as 0.35 milliseconds while still producing secondary voltages in the 48 to 50 KV range.

It is therefore an object of the invention to provide a novel, simple speed responsive spark advance circuitry.

Another object of this invention is to provide an improved construction of an ignition coil.

A further object of the invention is to provide a secondary voltage distribution system capable of distributing voltages in excess of 40 KV to spark plugs of an internal combustion engine without crossover firing and within the diameter of the conventional distributor caps of about $3\frac{7}{8}$ inches for an 8 cylinder engine.

A still further object of this invention is to provide a distributor cap for a V-8 engine having all spark plug cable outlets for the plugs on each side of the "V" on the corresponding side of the centerline of the distributor cap thus eliminating the necessity of the spark plug cables crossing over the cap to go to the proper spark plug.

A still further object of this invention is to increase the maximum operating speed of the ignition system while delivering full voltage output from the secondary winding of the ignition coil to the spark plugs of the internal combustion engine over speeds heretofore utilized.

Other objects, features and advantages of the present invention will become apparent from the subsequent description and appended claims taken in conjunction with the accompanying drawings.

BRIEF DESCRIPTION OF THE DRAWING

The present invention may be more readily described by reference to the accompanying drawings in which:

FIG. 2 is a graphic illustration comprising parts 2A–2H showing the voltages and currents encountered over a 45-degree rotation of an 8-cylinder engine ignition system operating on a 12 volt supply at the outputs of the various functional sections shown in FIG. 1, wherein:

Line A shows the open circuit voltage developed by the pickup coil;

Line B shows the voltage of the pickup coil when connected to a pulse modifier and with the entire circuitry in operation while delivering a spark with zero spark advance;

Line C shows the voltage of the pickup coil when connected to the pulse modifier and with the entire circuitry in operation while delivering a spark with 10 degrees distributor spark advance or 20 degrees engine advance;

Line D shows the output of an amplifier when sensors or the basic speed spark advance provides a signal to the pulse modifier sufficient to give a spark advance of 10 distributor degrees or 20 engine degrees;

Line E shows the output of a timer with 20 degrees of engine advance;

Line F shows the current flow through the primary winding of an ignition coil, again with 20 degrees of engine spark advance;

Line G shows the secondary winding voltage as it breaks down a 1-inch needle gap;

Line H indicates the current read on an ammeter placed in the feed circuit to the entire system during the continuous operation of the system at 14.0 circuit volts and 2,000 engine RPM.

Figure 3:
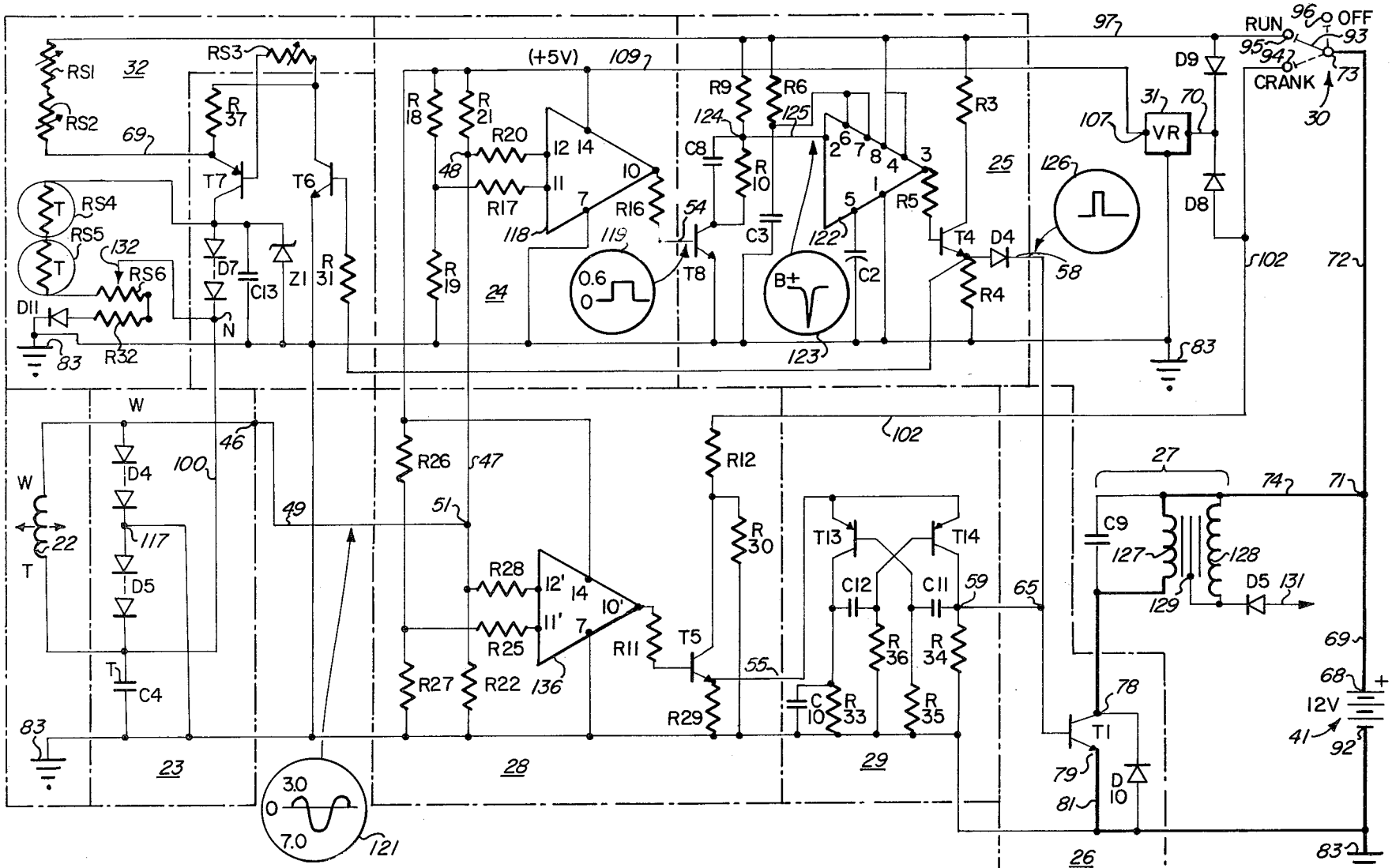

FIG. 3 is a schematic drawing illustrating the component forming the functional sections of the disclosed ignition system.

Figure 4:
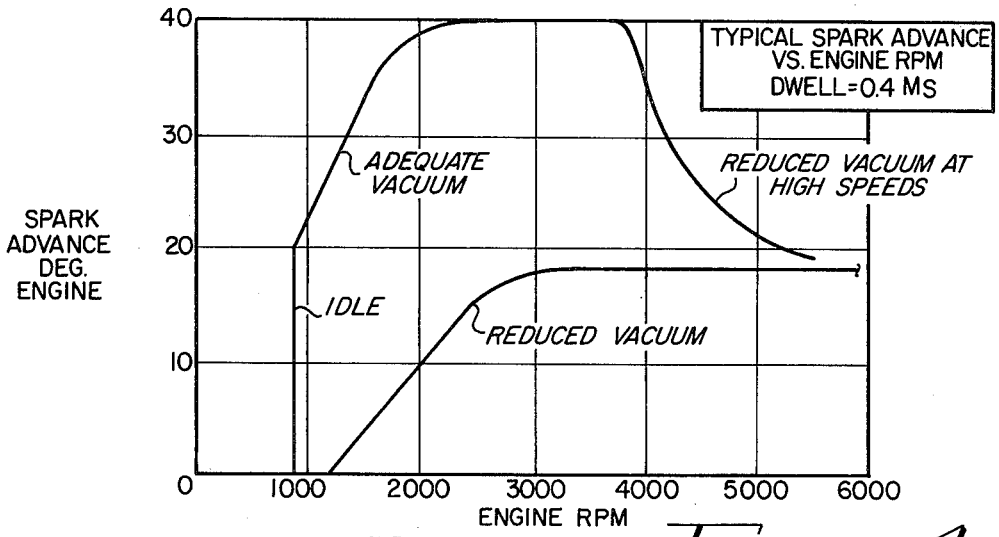

FIG. 4 is a graphic illustration showing the spark advance, as selected for a specific engine at both low and high engine vacuum.

Figure 6A:
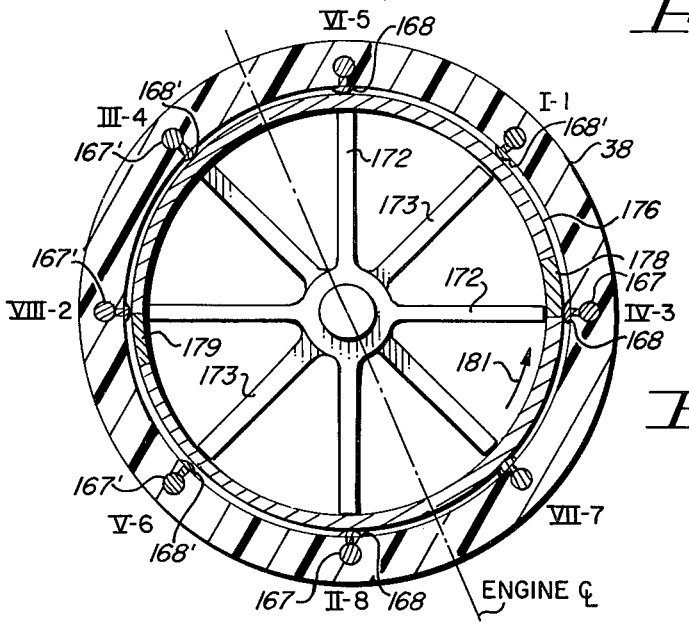
Figure 6:
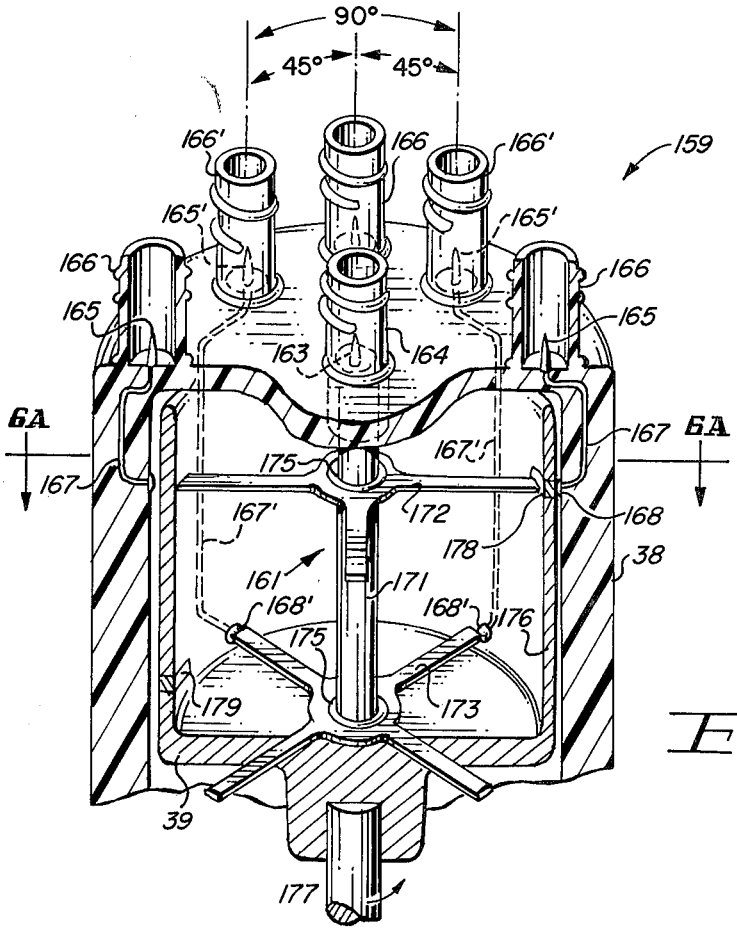
Figure 5:
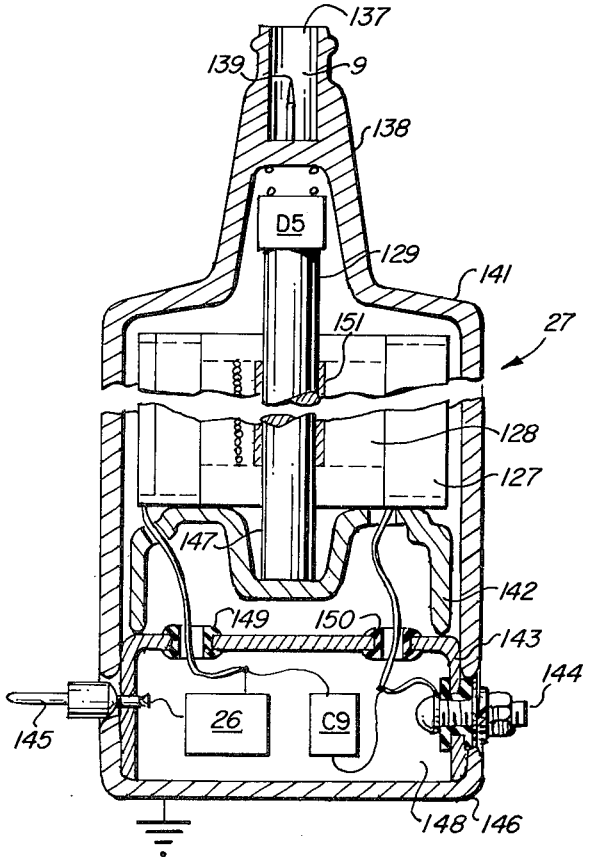

FIG. 5 is a vertical cross-sectional view through the ignition coil of the ignition system disclosed;

FIG. 6 is a sectional view through the high voltage distribution system of the distributor of the invention;

FIG. 6A is a sectional view through the high voltage distribution system of the structure shown in FIG. 6 along the line 6A—6A.

Figure 7:
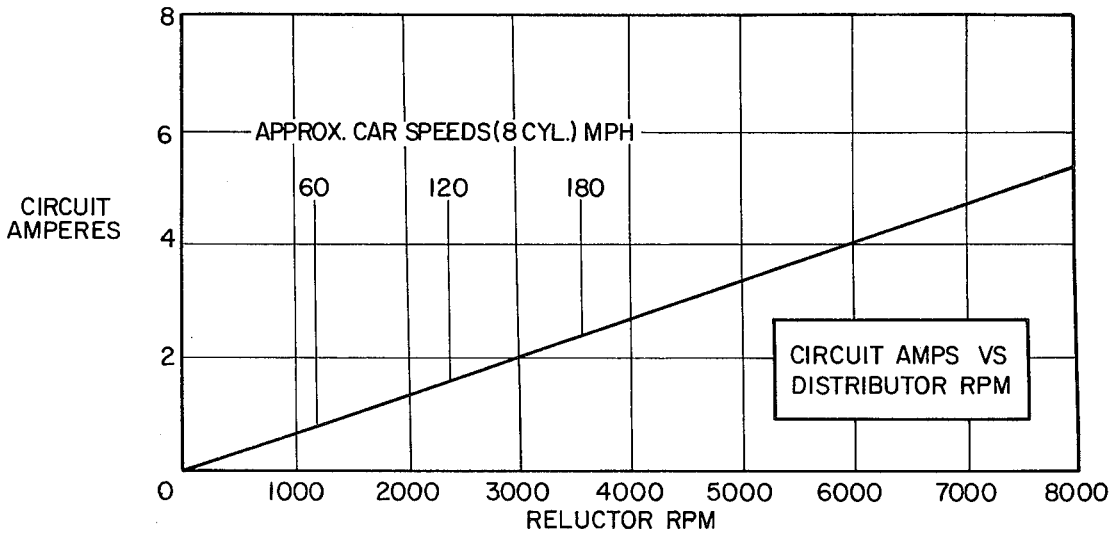
Figure 8:
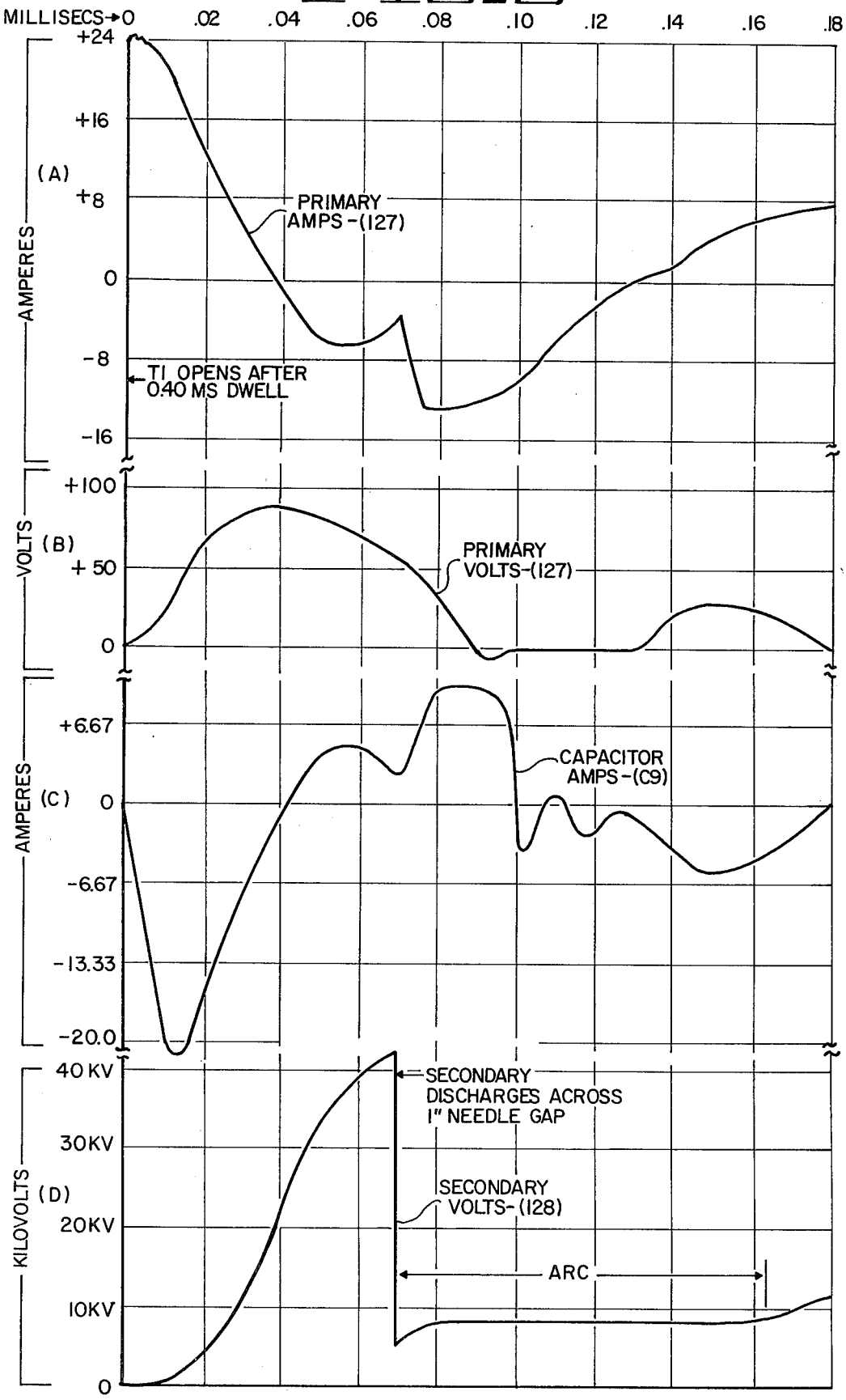

FIG. 7 illustrates diagrammatically the current of the circuit in relationship to reluctor speeds of an 8-cylinder engine; and FIG. 8 diagrammatically illustrates the coil voltage and currents immediately preceeding and subsequent to a spark in the ignition system disclosed.

DESCRIPTION OF THE PREFERRED EMBODIMENT

Figure 1:
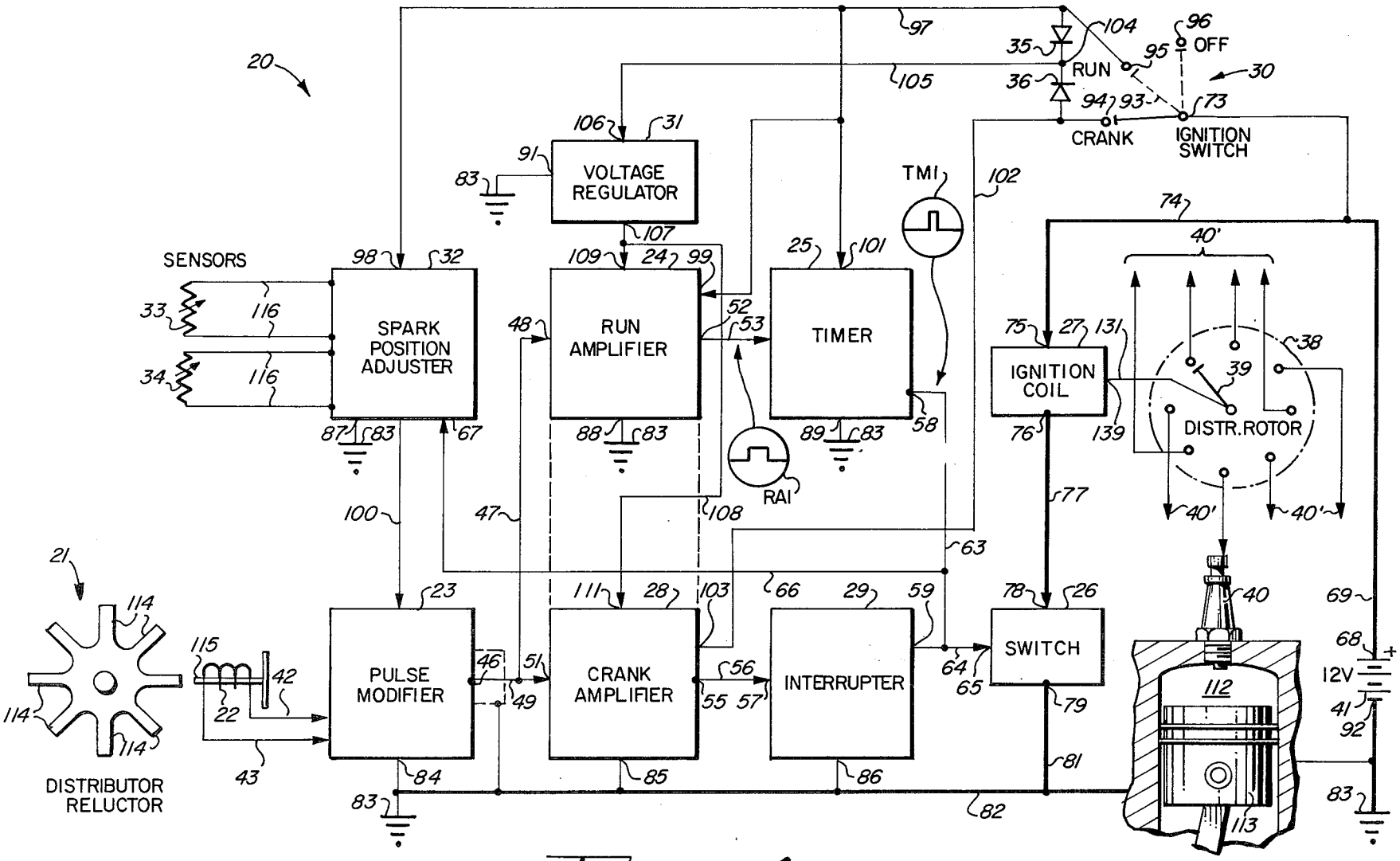
FIG. 1 is a block diagram of the system divided into functional sections.

Referring more particularly to the drawing by characters of reference, FIG. 1 discloses an improved electronic ignition system 20 of this invention comprising a reluctor 21 having as many teeth as cylinders in the associated engine, a pickup coil 22, a pulse modifier 23, a run amplifier 24, timer 25, switch 26, ignition coil 27, crank amplifier 28, interruptor 29, ignition switch 30, voltage regulator 31, spark position adjustor 32, sensors 33 and 34, diodes 35 and 36, distributor cap 38, distributor rotor 39, spark plugs 40 and 40' and battery 41.

The pick-up coil 22 is connected by its start and finish leads 42 and 43, respectively, to pulse modifier 23. Output 46 of pulse modifier 23 is connected by a conductor 47 to a first input 48 of run amplifier 24 and by a conductor 49 to a first input 51 of crank amplifier 28. Run amplifier 24 has its output 52 connected by a conductor 53 to a first input of timer 25. Crank amplifier 28 has its output 55 connected by conductor 56 to input 57 of interruptor 29. The outputs 58 and 59, respectively, of timer 25 and of interruptor 29 are connected to a common bus 63 which is connected by a first conductor 64 to a control 65 of switch 26 and by a second conductor 66 to a first input 67 of spark position adjustor 32.

The positive terminal 68 of battery 41 is connected by conductor 69 to ignition switch 30 and by a conductor 74 to the positive input terminal 75 of ignition coil 27.

The negative terminal 76 of ignition coil 27 is connected by conductor 77 to the positive terminal 78 of switch 26, and the negative terminal 79 of switch 26 is connected by conductor 81 to ground bus 82 which is connected to chassis ground 83. Also connected to ground bus 82 are the ground terminals 84, 85, 86, 87, 88, 89, and 91, respectively, of pulse modifier 23, crank amplifier 24, timer 25 and voltage regulator 31 and the negative terminal 92 of battery 41.

Ignition switch 30 has "CRANK", "RUN", and "OFF" positions with which the switch arm 93 makes connection from common terminal 73 to CRANK terminal 94, RUN terminal 95 and OFF terminal 96. RUN terminal 95 is connected to the anode of diode 35 and by a conductor 97 to inputs 98, 99 and 101, respectively, of spark position adjustor 32, run amplifier 24 and timer 25. Crank terminal 94 is connected by a conductor 102 to the anode of diode 36 and to a first input 103 of crank amplifier 28. The cathodes of diodes 35 and 36 are connected to a common point 104 which is connected by a conductor 105 to an input 106 of voltage regulator 31.

The output 107 of voltage regulator 31 is connected to inputs 109 and 111, respectively, of run amplifier 24 and crank amplifier 28.

Also shown in FIG. 1 is a cylinder 112 and piston 113 of an eight-cylinder internal combustion engine to which the ignition system 20 is connected.

System 20 operates in the CRANK (starting) mode when switch 30 is in the CRANK position and it operates in the RUN mode when switch 30 is in the RUN position. In the CRANK position, the crank amplifier 28 is enabled by battery voltage supplied through input 103 and conductor 102 while in the RUN position the spark position adjustor 32, run amplifier 24 and timer 25 are activated by battery voltage supplied from conductor 97.

Operation in the RUN mode

The distributor reluctor 21 is a gear-shaped wheel made of a magnetic material and it has a number of teeth 114 equal to the number of cylinders of the associated engine distributed symmetrically about its periphery. As the reluctor 21 is rotated by virtue of its mechanical coupling to the internal combustion engine, teeth 114, one at a time, pass core 115 of pickup coil 22. Through this action a cyclic variation of the flux linking coil 22 is effected and an alternating voltage is accordingly induced in coil 22 which is synchronized with the rotation of the engine.

The voltage output of pickup coil 22 is supplied by conductors 42 and 43 to pulse modifier 23 which modifies the alternating voltage pulses received displacing the pulses linearly relative to ground as a function of the speed of rotation of reluctor 21. Thus, as a reluctor tooth 114 approaches the core of the pickup coil 22, one end of coil 22 is positive relative to its other end, thus the output voltage applied to pulse modifier 23 reaches a positive level of X volts at some point in time prior to the time at which the tooth 114 reaches a position about six degrees ahead of direct alignment with core 115 of the pickup coil 22.

In the RUN mode, the output signal of pulse modifier 23 is delivered to run amplifier 24 which responds by delivering a rectangular output voltage pulse RAI. Run amplifier 24 turns on to initiate pulse RAI at the instant the output signal of pulse modifier 23 reaches the level of X volts and it turns off to terminate pulse RAI as the output signal of pulse modifier 23 falls below this level.

The output of run amplifier 24 is delivered as an input signal RAI to timer 25. Timer 25 produces a positive rectangular output voltage pulse TMI which is initiated at the leading edge of input signal RAI and is terminated at the end of a fixed time interval thereafter. With the proper operation of pulse modifier 23, in the absence of sensor signals, pulse TMI will be terminated at all engine speeds just as tooth 114 reaches the point about six degrees ahead of direct alignment with core 115 of pickup coil 22. This time relationship is achieved through the action of pulse modifier 23 in appropriately shifting its output voltage relative to ground as engine speed varies.

Pulse TMI from timer 25 is delivered to the control terminal 65 of switch 26 and causes switch 26 to be turned on during the constant time interval of pulse TMI. While switch 26 is turned on, current flows from the positive terminal 68 of the 12 V battery 41 through the primary winding of ignition coil 27 and through switch 26 to the negative terminal 92 of the battery. It should be recognized that the system can function on other voltages, such as 6, 18 and 24 volts with adjustments according in the circuit parameters.

The design of ignition coil 27 is such that its core reaches saturation during the period of time that switch 26 is turned on. When current in the primary winding is terminated, the flux in the core of coil 27 collapses rapidly, producing a high voltage in its secondary winding by virtue of the action of timer 25. As described earlier, the high secondary voltage pulse of coil 27 is always initiated in the absence of sensor signals about six degrees ahead of alignment between tooth 114 and the core of pickup coil 22, and consequently at a constant piston position independent of engine speed.

The high voltage pulse thus developed by coil 27 is distributed by the high voltage distributor cap 38 and rotor 39 to the spark plugs 40 and 40'.

Because the duration of pulse TMI developed by timer 25 is constant while its repetition rate is proportional to engine speed, the d-c or average value of the signal TMI will vary directly with engine speed. This relationship is utilized to produce a spark advance whereby the signal TMI is delivered via line 66 to spark position adjustor 32 which reacts by producing a voltage that is fed back to pulse modifier 23 via line 100. Voltage fed back to pulse modifier 23 causes an appropriate shift in the level of the output of pulse modifier 23 with respect to ground as required to produce the desired spark advance.

The basic speed responsive spark advance may be made responsive also to other signals related to engine performance, such as engine vacuum, temperature, rate, throttle position, acceleration rate, etc. For this purpose, the sensors 33 and 34 are provided, which are shown connected to spark position adjustor 32 by signal lines 16. The automatic adjustment of ignition timing relative to these and other parameters may be employed to optimize vehicle operation and to limit emissions in the engine exhaust.

Figure 2:
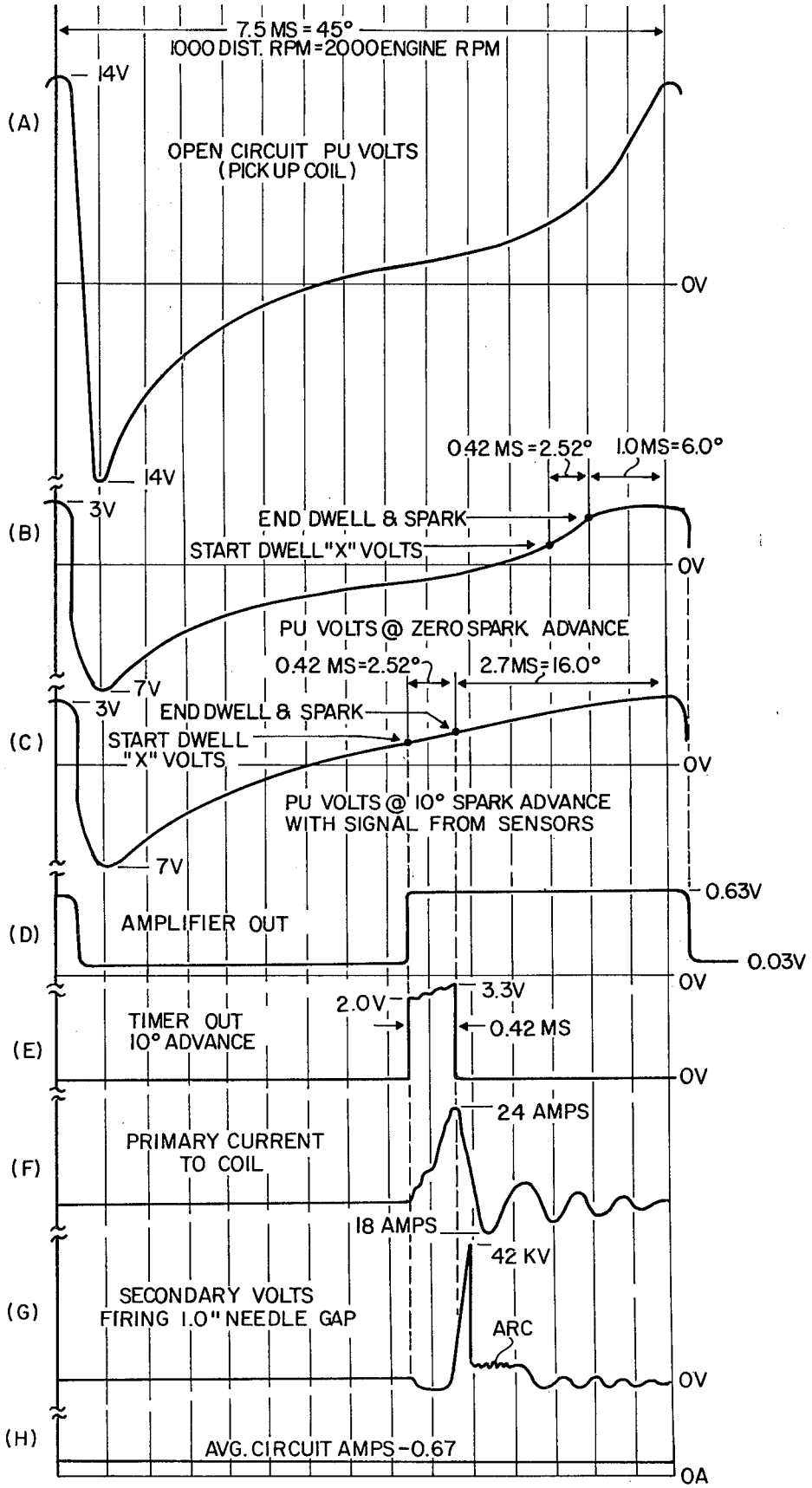

Operating waveforms for the circuits described thus far are shown in FIG. 2. The waveforms correspond to forty-five degrees of rotation of reluctor 21 which covers the development of a single firing pulse in coil 22 as initiated by the movement of one of the teeth 114 past pickup coil 22. The waveforms of FIG. 2 are taken from laboratory tests of a complete system firing a one-inch needle gap operating at 1,000 distributor RPM under the control of the ignition system 20 of FIG. 1. FIG. 2A shows the open circuit voltage developed in pickup coil 22 as tooth 114 of reluctor 21 approaches and then moves on past the core of coil 22. FIG. 2B shows the voltage developed in pickup coil 22 when connected to pulse modifier 23 with the circuits of FIG. 1 in operation under conditions calling for zero spark advance. FIG. 2C shows the same signal but modified through the action of the spark position adjustor 32 feeding the pulse modifier 23 to produce 10 degrees of distributor spark advance or a 20 degree advance relative to engine rotation. FIG. 2D shows the output of run amplifier 24 under conditions producing 10 degrees of distributor spark advance and FIG. 2E shows the output of timer 25 under the same conditions. Current flow through the primary winding of ignition coil 27 is shown in FIG. 2F, and the voltage developed in the secondary winding of coil 27 is shown in FIG. 2G. Average current drawn by the circuit of FIG. 1 during operation at an engine speed of 2,000 RPM is shown in FIG. 2H.

The interrelationship of the waveforms of FIG. 2C through 2G is in conformance with the operation of the circuits of FIG. 1 as previously described. Thus, for example, the initiation of the output pulse of amplifier 24 as shown in FIG. 2D coincides with the point at which the pulse modifier 23 output voltage reaches X bolts, as shown in FIG. 2C. The signal produced by timer 25 is initiated at the same time and persists for a fixed time interval of approximately 0.042 milliseconds. The primary current of coil 27 as shown in FIG. 2F rises to a peak value during the interval of the timer signal. Upon the interruption of current flow through the primary winding of coil 27, the output pulse from its secondary coil is shown in FIG. 2G when firing a 1-inch needle gap.

When the system 20 is operating in the CRANK mode, the output of pulse modifier 23 is received by crank amplifier 28 at its input 51. Amplifier 28 responds by delivering a series of pulses at its output terminal 55 each time it is enabled at its input. The series of output pulses is delivered to switch 26 via conductor 64 to produce the desired series of sparks to plugs 40 and 40' for starting the engine.

Details of the circuits comprising the system 20 of FIG. 1 are shown in the circuit diagram of FIG. 3. Corresponding circuit blocks are identified by the same numerals in FIGS. 1 and 3.

The pulse modifier 23 comprises two series strings of diodes D4 and D5 and a capacitor C4. The series diodes D4 and D5 are all polarized in the same direction with the positive or anode end of string D4 connected to terminal W of coil 22 and the negative or cathode end of string D5 connected to terminal T of coil 22 so that when a voltage is induced in coil 22 the diode strings D4 and D5 will pass current when terminal W of coil 22 is positive with respect to its terminal T and they will block current flow during the opposite polarity of induced voltage. Terminal T of coil 22 and the cathode end of diode string D5 are connected to plate T of capacitor C4, and the opposite plate of capacitor C4 is connected to chassis ground 83. Also connected to the T plate of capacitor C4 is the line 100 which delivers the output signal of the spark position adjustor 32. The junction 117 between diode strings D4 and D5 is connected to chassis ground 83, and the output terminal 46 is connected to terminal W of diode string D4.

The serially connected diode strings D4 and D5 form a unidirectional voltage divider the resistance of which varies with the applied voltage. Furthermore, it has been found that in the absence of sensor signals and with the proper selection of the number and type of diodes D4 and D5 for a given design of coil 22 and with a proper value of the capacitor C4, the pulse modifier 23 output voltage at terminal 46, when connected to the common input terminal 51 of amplifiers 24 and 28 will reach a positive fixed value of "X" volts, a constant time interval in advance of the instant when a booth 114 of reluctor 21 reaches a position about 6 degrees prior to direct alignment with the core 115 of coil 22, in the absence of sensor signals, at all engine speeds. In a practical application of this circuit, the following parameters are used:

| | |
|---|---|
| pickup coil 22: | 3,000 turns of #40 wire |
| diode string D4: | 5 silicon diodes |
| diode string D5: | 3 silicon diodes |
| capacitor C4: | 10 microfarods. |

In the RUN mode of system 20, the output signal of pulse modifier 23 is delivered by conductors 49 and 47 to input 48 of run amplifier 24, amplifier 24 comprising a voltage comparator 118, with an output resistor R16, input resistors R17 and R20, divider resistors R18 and R19, and divider resistors R21 and R22 (as shown in crank amplifier 28). Comparator 118 is an integrated circuit having a supply pin 14, a ground pin 7, a non-inverting input pin 12, an inverting input pin 11, and an output pin 10. The comparator 118 produces a positive signal at its output pin 10 when pin 12 is positive with respect to pin 11 and it produces no signal at pin 10 when pin 11 is positive with respect to pin 12.

In run amplifier 24, the divider resistors R18 and R19 are serially connected between the positive five-volt supply line 109 and chassis ground 83. The common point between resistors R18 and R19 is connected through resistor R17 to inverting pin 11 of comparator 118. A fixed reference voltage is thus supplied to pin 11 at a level of approximately "X" volts. Conductor 47, which delivers the signal from pulse modifier 23, is connected to non-inverting input pin 12 through resistor R20 and to supply conductor 109 through resistor R21. Output pin 10 of comparator 118 is connected to run amplifier output 54 through resistor R16. Resistor R22, which is shown to be located inside crank amplifier 28, is connected between terminal 48 and ground 83 so that, together, resistors R21 and R22 form a divider network which biases pin 12 at a level which causes pin 12 to be negative with respect to the reference level established at pin 11 when there is no signal present on line 47 and the output pin 10 under this condition will be at ground potential. For all values of the input signal in excess of "X" volts appearing at terminal 48, the output pin 10 will deliver a positive signal approaching the five-volt supply voltage connected at pin 14. A square-wave output pulse 119 is thus produced at pin 10 in response to the irregular waveform 121 produced by coil 22 and pulse modifier 23.

Timer 25, which receives signal 119 from amplifier 24, includes a trigger stage, a timer circuit and an output stage.

The trigger stage comprises transisor T8, resistors R9 and R10 and capacitor C8. Resistors R9 and R10 are serially connected from the collector of transistor T8 to regulated voltage bus 109 with R10 connected directly to the collector, and capacitor C8 connected across resistor R10. The base of transistor T8 serves as the input 54 of timer 25 and is connected to output of amplifier 24.

The timer circuit comprises an integrated circuit (IC) timer 122, a timer network, R6 and C3, and a stabilizing capacitor C2. Timer 122 is a commonly used integrated circuit produced by several manufacturers, as a type 555 timer. Capacitor C2 is connected from pin 5 to ground, pin 1 is connected to ground, pins 4 and 8 are connected to supply conductor 97, resistor R6 is connected from supply conductor 97 to pins 6 and 7, and capacitor C3 is connected from pins 6 and 7 to ground. Pin 2 is the trigger input terminal and pin 3 is the output terminal. When connected in this manner, with resistor R6 and capacitors C2 and C3, timer 122 functions as a monostable multivibrator which is triggered by the leading edge of a negative pulse applied at terminal 2 and responds by delivering a positive pulse of fixed duration at output terminal 3. The duration of the positive pulse is determined by the time-constant (R6)(C3).

The output stage of timer 25 comprises a transistor T4, collector resistor R3; base resistor R5 and diode D4. Transistor T4 has its collector connected through resistor R3 to supply conductor 97, its emitter is connected to ground through resistor R4 and its base is connected through resistor R5 to pin 3 of timer 122.

In the operation of timer 25, the application of the square-wave positive pulse 119 to the base of transistor T8 renders transistor T8 conductive and its collector voltage falls abruptly to ground. Charging current flowing through resistor R9 and capacitor C8 produces a negative pulse 123 at the junction 124 between resistor R9 and capacitor C8. The negative pulse 123 is delivered to trigger pin 2 of timer 122 by a line 125 which is connected to pin 2 from junction 124. Responding to pulse 123, timer 122 produces a positive pulse at its output pin, the pulse driving transistor T4, which provided power amplification. The output of transistor T4 is developed as a positive pulse across emitter resistor R4 and is coupled through diode D4 to output terminal 58 of timer 25. The positive pulse delivered to terminal 58 is a square-wave pulse 126 which is utilized to drive switch 26.

Switch 26 is an NPN transistor TI. The base of transistor TI serves as the control terminal 65 of switch 26, the collector serves as the positive switch terminal 78, and the emitter, which is connected to ground, serves as the negative switch terminal 79. A by-pass diode D10 is connected across transistor TI, its cathode connected to the collector and its anode to the emitter. Diode D10 protects transistor TI against reverse current flow which may be developed through parasitic oscillations.

The ignition coil 27 comprises a primary winding 127, a secondary winding 128, a capacitor C9, a magnetic core 129 and a diode D5. Primary winding 127 is connected at one end to the positive switch terminal 78 and at the other end through conductors 74 and 69 to the positive terminal of battery 41. Capacitor C9 is connected directly across primary winding 127.

Switch 26 turns on during the pulse 126 to excite the primary winding 127 of coil 27. During the time that transistor TI is rendered conductive by pulse 126, current flows from the positive terminal of battery 41 through conductors 69 and 74, winding 127 and transistor TI to the negative terminal 92 of battery 41. During this time, the current builds up in winding 127 at an approximately constant rate from zero to peak value. The duration of the pulse 126 is held constant by timer 25. A relatively constant value of energy ($\frac{1}{2}$ $LI^2$) is thus stored in winding core combination 127, 129 each time the switch 26 is pulsed.

At the end of pulse 126, transistor TI turns off and the magnetic flux in core 129 collapses rapidly, inducing a high voltage pulse in secondary winding 128, which is coupled to distributor rotor 39 through diode D5 and conductor 131. Diode D5 is back-biased during the conduction of transistor TI, blocking current flow until the secondary voltage reverses with the turn-off of transistor TI. Capacitor C9 absorbs enery during the turn-off of transistor TI, thereby reducing the peak voltage developed across transistor TI. This permits the use of a less costly transistor for transistor TI.

Also operative during the RUN mode is the spark position adjustor 32, which comprises transistors T6 and T7, diode 11, diode string D7, zener diode Z1, capacitor C13, sensor resistors RS1, RS2, RS3, RS4, RS5 and RS6 and fixed resistors R31, R32, and R37. Diode string DD7 comprises two or more serially connected diodes. Sensor resistors RS1 and RS2 are serially connected from conductor 97 to the emitter of PNP transistor T7. Resistor R37 is connected between the emitter of transistor T7 and the collector of NPN transistor T6 and sensor resistor RS3 is connected between the base of transistor T7 and the collector of transistor T6. The emitter of transistor T6 is connected to chassis ground 83 and its base is connected through resistor R31 to the emitter of transistor T4 of timer 25. Zener diode Z1 and capacitor C13 are connected to the collector of transistor T7 to ground 83. Diode string D7 is connected between the collector of transistor T7 and terminal node N. Connected in parallel with string D7 are serially connected sensor, resistors RS4, RS5 and RS6.

Resistor RS6 is a potentiometer operated by engine vacuum. It has a movable arm or wiper 132 and a wound resistive element. The one end of resistor element is connected to one end of sensor resistor RS5 while the other end of the resistor element is connected through resistor R32 and diode D11 to ground 83. The wiper 132 is connected to node N.

The operation of spark adjustor 32 occurs as follows:

One function of spark position adjustor 32, i.e., the advancement of the spark with speed, is accomplished in response to the signal from timer 25. This signal is recieved at the base of transistor T6 and is supplied through resistor R31 from the emitter of transistor T4. Because transistor T4 of timer 25 is pulsed, and because the pulse rate is proportional to speed, the average value of the voltage developed across resistor R4 is directly proportional to engine speed. As this signal is coupled to the base of transistor T6, transistor T6 becomes increasingly conductive with engine speed. The increasing collector current drawn by transistor T6 is drawn primarily through sensor resistor RS3 from the base of transistor T7. As a consequence, transistor T7 also becomes increasingly conductive with engine speed and its increasing collector current flow through diode string D7 into capacitor C4. This increases the voltage across C4 and is added to the pulse induced in coil 22, and the sum of the capacitor voltage and the coil pulse reaches the level of "X" volts at an earlier time relative to the instantaneous engine position so that rum amplifier 24 is triggered earlier and the spark generated in ignition coil 27 is generated at a correspondingly earlier point in the cycle.

The spark advance function is programmed by the sensors RS1 through RS6 and by diode string D7. Resistor R32 and diode D11 as well as zener diode Z1 performs limiting functions. Because of the integrating effect of capacitor C13, the pulsating current supplied from the collector of transistor T7 produces a d-c level at the positive plate of capacitor C13. This d-c level rises with engine speed until it reaches the breakover voltage of zener diode Z1. The point at which this occurs corresponds to the maximum degree of spark advance, except for the additional controlling effects of the sensor RS1–RS6. Thus, for example, at a given level of voltage at the positive plate of capacitor C13, the total series resistance offered by sensor resistors RS4, RS5 and RS6 has an effect on the current delivered to capacitor C4. If their series resistance decreases, an increasing amount of current is shunted around diode string D7, the shunted current flowing from the collector of transistor T7 through sensor resistors RS4, RS5 and RS6 to line 100 and capacitor C4. As the resistance of any of these resistors decreases, the voltage on capacitor C4 increases and the spark is advanced accordingly until transistor T7 becomes unsaturated, i.e. until the drive to transistor T7 becomes the limiting factor. At this point, the sensor resistors RS1–RS2 come into play. A reduction in the resistance of any of these elements results in an increased availability of current from transistor T7. Thus, for example, as RS3 resistance decreases, the base drive to transistor T7 is increased. As the resistance of RS1 or RS2 decreases, the voltage at the emitter of transistor T7 tends to rise, again promoting increased base drive and increased collector current. In summary, a decrease in resistance of any of the sensor resistors RS1–RS7 produces increased charging current to capacitor C4.

Each of the sensor resistors RS1–RS6 may respond to a different operating parameter. The sensor resistor RS6, for example, is preferably controlled by engine vacuum, and sensor resistors RS4 and RS5 are controlled by engine temperature and intake air temperature, their resistance decreasing with temperature. At high engine vacuum, the wiper 132 is moved toward the junction of RS6 and RS5, thereby decreasing the resistance of RS6 and so advancing the spark. At low engine vacuum, the wiper 132 is moved toward the junction of RS6 and R32, thereby increasing the resistance of RS6 and delaying the spark until finally wiper 132 reaches the end of its travel at this point, node N is clamped to ground 83 through resistor R32 and diode D11. Because of the series resistance afforded by resistor R32, the current supplied to capacitor C4 is still responsive to engine speed, but the effect is appreciably reduced, and at higher speeds is limited to the extent necessary for the attainment of a maxium advance for any values of sensor resistors RS1, RS2 and RS3.

The port providing the vacuum which controls sensor resistor RS6 is located in the throat of the carburetor, just above the throttle blade. This renders the spark advance inoperative during idle and until the throttle is opened slightly.

Sensor resistors RS1–RS3 may be made responsive to any desired engine parameter, such as throttle position or rate of opening, torque, acceleration, etc.

The proper design of the spark position adjustor 32 and the associated sensor resistors RS1–RS6 permits the control of the spark position, as desired, one such typical relationship is shown in FIG. 4.

In the RUN mode of operation just described, the ignition switch 73 was set in the RUN position with switch arm 93 making contact with RUN terminal 95. Voltage from the positive plate of battery 41 is thus applied through conductors 69 and 72 to ignition switch 30 through arm 93 to terminal 95 and conductor 97. From conductor 97 voltage is supplied through diode D9 to voltage regulator 31 as well as to the various circuits which are operative during the RUN mode including the spark position adjustor 32, run amplifier 24 and timer 25. The voltage regulator 31 which has been energized by the voltage supplied through diode D9 delivers five volts at its output terminal 107 which is distributed by bus 109 to RUN amplifier 24 and crank amplifier 28. It will be noted, however, that crank amplifier 28 is disabled in the RUN position of switch 30 because no voltage is made available to the collector of transistor T5 through conductor 102. Furthermore, because interruptor 29 can only be energized by transistor T5, this circuit is also rendered inoperative during the RUN mode.

During the CRANK mode, arm 93 of switch 30 makes contace with CRANK terminal 94 to that battery voltage is supplied through conductor 102 and diode D8 to voltage regulator 31 but is blocked from conductor 97 by diode D9. Battery voltage is also supplied by conductor 102 to the collector or transistor T5 in CRANK amplifier 28 so that CRANK amplifier 28 is enabled. Because no voltage is delivered to conductor 97, the spark position adjustor 32 and the timer 25 are rendered inoperative.

The CRANK amplifier 28 comprises a voltage comparator 136, NPN transistor T5 and resistors R11, R12, R21 (as shown in Run Amplifier 24) R22, and R25 through R30. Comparator 136 is identical to comparator 118 of Run Amplifier 24. Its inverting input terminal 11' is connected through resistor R25 to the common point between divider resistors R26 and R26 which are serially connected between bus 109 and ground 83 to provide a reference voltage at their common terminals. The non-inverting input terminal 12' of comparator 136 is connected through resistor R28 to input terminal 51 of CRANK amplifier 28. Resistors R21 and R22 form a voltage divider which is common with Run Amplifier 24. Supply terminal 14 is connected to bus 109 and ground terminal 7 is connected to chassis ground 83. Transistor T5 has its base connected through resistor R11 to output terminal 10' of comparator 136, its emitter is connected to ground 83 through resistor R29 and its collector is tied to the common point between serially connected resistors R12 and R30, which form a divider between ground 83 and battery voltage supplied at conductor 102. The emitter of transistor T5 is also connected to output terminal 55 of CRANK amplifier 28.

Interruptor 29 comprises PNP transistors T13 and T14, resistors R33–R36 and capacitor C10–C12 connected as a free-running multivibrator. The emitters of transistors T13 and T14 are connected together and also to terminal 55. The base of transistor T13 is connected to ground through resistor R35 and the base of transistor R14 is connected to ground through resistor R36, the collectors of transistors T13 and T14 are connected to ground through resistors R33 and R34, respectively, and capacitor C10 is connected in parallel with resistor R33. Capacitor C11 is connected from the base of transistor T13 to the collector of transistor T14 and capacitor C12 is connected from the base of transistor T14 to the collector of transistor T13.

Operation of CRANK amplifier 28 and interruptor 29 occurs as follows:

As the signal from pulse modifier 23 exceeds the level of "X" volts, the non-inverting input terminal 12' of comparator 136 becomes positive with respect to inverting input terminal 11', which is referenced to "X" volts by divider resistors R26 and R27. As terminal 12' exceeds "X" volts output, terminal 10' switches abruptly from ground potential to a value slightly below +5 volts and supplies base drive to transistor T5, causing its emitter voltage to rise and thereby exciting interruptor 29 by raising the emitters of transistors T13 and T14 to approximately four volts above ground. The base of transistor T14 is held more solidly to ground than that of transistor T13 by virtue of the series connection of capacitors C10 and C12 from the base of transistor T14 to ground. For this reason transistor T14 turns on first, and as it does its collector voltage rises coupling a positive voltage to the base of transistor T13, which holds transistor T13 in a non-conductive condition. Then as capacitor C11 charges toward the collector voltage of transistor T14, the base voltage of transistor T13 declines until transistor T13 turns abruptly on. The abrupt turn-on of transistor T13 produces a sharp rise in its collector voltage which is coupled through capacitor C12 to the base of transistor T14 to turn transistor T14 off. The interruptor 29 is thus seen to function in the manner of the conventional multivibrator in which the two transistors conduct and turn off alternately with a square wave produced at the collector of each transistor. The conduction periods are determined by the time constants (R33)(C12) and (R34)(C11), which are set relatively low so that each time a pulse is supplied at terminal 55 by CRANK amplifier 28, the interruptor 29 produces a series of square-wave pulses at its output terminal 59. The two time constants are set for a pulse width of approximately 0.85 milliseconds and a separation of 0.3 milliseconds. The series of pulses from terminal 59 are supplied to switch 26, causing it to respond by alternately energizing ignition coil 27 thus producing a series of sparks over about six degrees of rotation of reluctor 21. The longer pulse time produced by interruptor 29 provides sufficient time to permit saturation of the ignition coil 27, core 129 when the battery 41 voltage is reduced during cranking.

The physical construction of the ignition coil 27 is shown in FIG. 5. The ignition coil 27 comprises a bottle-shaped insulating housing 141, the magnetic core 129, primary winding 127, secondary winding 128, a bell-shaped insulating spacer 142, a cup-shaped magnetic shield 143, feed-through terminals 144 and 145, diode D5, capacitor C9, switch 26 and base cap 146. Extending upward from the base of a cylindrical depression 137 in the end of the neck 138 at the top of housing 141 is a high-voltage pin 139.

The bell-shaped insulating spacer 142 has a central depression 147, which serves as a support for the lower end of the core 129. The base of the spacer 142 rests atop the inverted cup-shaped shield 143, which fits inside the open lower end of housing 141. The base cap 146 closes the lower end of shield 143, forming a closed compartment 148 inside shield 143 for housing the switch 26 and the capacitor C9.

External access to the compartment 148 is by means of the terminals 144 and 145, which penetrate the side walls of shield 143, and access from compartment 148 to the primary winding 27 enclosed by housing 141 is through two insulating grommets 149 and 150, which are captured in two holes located in the flat top surface of shield 143.

The core 129 is preferably constructed of about 33 strips of high quality magnetic iron, 3/16 inches wide, 0.014 inches thick, and long enough to project one inch or more beyond the ends of the secondary winding 128. Alternatively, core 129 may be of ferrite material, as produced by Indiana General and others. In this case, a larger diameter will be required because of the reduced achievable flux density.

An insulating tube 151, which slips over the core 129, serves as the coil form over which the secondary winding 128 is wound.

Secondary winding 128 is wound in a manner which reduces the amount of energy stored in the layer-to-layer capacitance during the collapse of the field in the core 129. Each layer is wound from left to right or vice versa, the finish conductor being returned from right to left in a one-turn spiral for the start of the next layer. A layer of insulation is placed over each winding layer and another over the spiral return. This method of winding produces a constant layer-to-layer voltage of E volts between the entire length of the layers, whereas the conventional manner of winding in which alternate layers are wound from right to left and from left to right produces a linear voltage variation from zero to 2E volts between the length of the layers. Assuming the same value of layer-to-layer capacitance for the two winding methods, the method employed in this invention reduces the energy stored in the capacitance to sixty-seven percent of the energy stored in the conventionally wound coil. The secondary winding has a total of approximately 25,000 turns. The start of the secondary winding is connected to the core 129. The finish of the secondary winding and the start of the primary winding are connected to terminal 144, to which connection is made from the positive terminal of battery 41 by conductors 74 and 69. The top end of the core 129 makes electrical contact with the cathode of diode D5, which couples the voltage from secondary winding 128 to pin 139. As shown in FIG. 1, pin 139 is connected by conductor 131 to the rotor 39 of the distributor cap 38.

Primary winding 127 is wound over the top of secondary winding 128. The conductor is a flat strip material having a width panel, approximately, to the length of the secondary winding 128. Each turn is wound over the preceding turn with a strip of insulation wound in to insulate each turn from the next. In the preferred implementation, there are about 56 turns in primary winding 127 for a 12-volt supply, wound as described with one turn per layer. The d-c resistance of the winding 127 is very low (approximately 0.025 ohms) so that the rise of current in the primary winding is limited almost exclusively by the inductance of primary winding 127.

The entire housing 141 and the compartment 148 are sealed at all the joints and filled with a high quality dielectric oil.

In a coil of this type, the capacitive energy stored in the inter-layer capacitance is many times greater in the secondary winding 128 than in the primary winding 127. For this reason and also because of the inherent leakage inductance between the primary and secondary windings, the rise of secondary voltage following the opening of switch 26 will be delayed appreciably relative to the rise of the primary voltage. The connection of capacitor C9 across primary winding 127 delays the rise of the primary voltage so that it tends to coincide with the rise of the secondary voltage. As described in co-pending application Ser. No. 654,299 of Feb. 2, 1976, the discharge of current from this capacitor back through the primary winding also tends to reset the core permitting a higher level of energy storage and recovery.

The reduction in secondary winding capacitance by virtue of the winding method employed also permits a higher peak energy to be developed at the output terminal of the coil while the increased primary capacitance achieved through the strip winding advantageously increase primary winding capacitance.

These benefits result in a reduction in the "dwell" time, i.e. the period of primary current flow which is required to achieve a given level of secondary voltage. In the implementation of the invention, the "dwell" time was reduced by virtue of this construction of 0.35 milliseconds, as compared with a "dwell" time of 0.56 milliseconds, as shown in application Ser. No. 654,299. The benefit of the reduced "dwell" time is a capability for producing high-voltage discharges at a given voltage level at a considerably higher firing rate with less energy input required.

A more detailed description of the operation of ignition coil 27 and switch 26 is now possible with reference to the construction features just described and also with reference to the operating waveforms of FIG. 8.

The waveforms of FIG. 8 show currents and voltages in primary and secondary windings 127 and 128 and in capacitor C9 for the period immediately following the turn-off of switch 26.

At the instant just prior to the opening of switch 26 the current in primary winding 127 has reached a level of 24 amperes, having risen at an approximately constant rate from zero at the point of turn-on of switch 26. This period of energy storage corresponds to the "dwell" period referenced earlier and its duration is approximately 0.40 milliseconds.

At zero time in FIG. 8, transistor T1 of switch 26 is turned off and the current in primary winding begins to decay as shown in FIG. 8(A). Because transistor T1 is turned off, the primary current seeks another path and finds it in capacitor C9, where capacitor current is seen to rise in approximately 0.01 milliseconds to more than 20 amperes FIG. 8(C). The 0.01 milliseconds accounts for the time required by transistor T1 to turn off.

At 0.01 milliseconds and continuing to 0.07 milliseconds the collapse of the flux in core 129 accompanies an oscillatory energy exchange between primary winding 127, capacitor C9 and the interlayer capacitance of secondary winding 128. The sinusoidal contours of the current and voltage waveforms during this period is evidence of the high-Q (low resistance) achieved in the design of coil 27. At 0.04 milliseconds the circulating current through capacitor C9 and primary winding 127 has reversed its polarity returning the magnetization in core 129 to zero. At 0.07 milliseconds the voltage across secondary winding and its inter-layer capacitance has reached 42,000 volts when breakdown occurs at the needle gap simulating the firing of a spark plug.

The buildup of primary current following the initiation of the discharge at 0.07 milliseconds is a reflection of secondary discharge current in which energy is transferred by transformer action from capacitor C9 and primary turn-to-turn capacitance to the secondary winding 128 and eventually to the discharge arc. A damped oscillation follows until all stored energy is dissipated in the arc. The capacitive energy transferred from capacitor C9 to the arc helps to extend the period of the arc discharge, assisting materially in the ignition of the leaner and colder mixtures present in the cylinder under certain conditions.

It will be appreciated that except for the primary winding capacitance and the additional capacitance provided by capacitor C9, the primary voltage would rise to a higher level during the turn-off of transistor T1. The total primary capacity has also been shown to provide supplementary energy to the discharge arc.

Polarization of the secondary winding 128 relative to that of the primary winding 127 is such that diode D5 is reverse-biased and hence blocks secondary current flow during the "ON" time of switch 26, otherwise referenced as the "dwell" time. The polarity of secondary voltage is reversed at time zero in FIG. 8 when switch 26 turns off.

Because the collapse of the flux in core 129 occurs at a much higher rate than the rate at which it was established, both primary and secondary voltages are considerably higher following the opening of the switch 26 than prior to the opening of the switch. Secondary voltage following the opening of the switch may exceed 50 kilovolts and primary voltage can go to 130 volts should larger dwell time be used.

The constant energy level of the discharge achieved over the speed range of the engine is evidenced by the linear rise of current drawn from the battery as a function of speed. This relationship is illustrated in FIG. 7, which shows average current as a function of reluctor RPM. Approximate corresponding road speeds are also indicated for an eight-cylinder engine.

The construction of a high-voltage distributor designed for use with the present invention is shown in FIGS. 6 and 6A.

The distributor 159, as shown in FIGS. 6 and 6A, comprises a stationary cap 38, a stationary spider assembly 161 and a revolving commutator cup or rotor 39.

The cap 38 is in the form of an inverted cup and is molded from a rugged insulating material. Extending upwardly from the center of the flat top surface is a connector pin 163 protected by an insulating busing 164. Surrounding pin 163 and evenly spaced in a circle near the outer edge of the top surface of cap 38 are eight additional connector pins 165, 165' and associated bushings 166, 166'. The pin 163 serves as a connecting means for introducing the spark from ignition coil 27 and the surrounding pins 165, 165' which are spaced at 45-degree intervals serving as the connecting means for the spark plugs of an eight-cylinder engine.

Alternate pins are labeled 165 and 165' to distinguish two groups of four pins, the first group including the four pins 165 are spaced at 90 degree intervals about the circumference of cap 160 and the other four pins 165' are spaced half way between the first four pins.

Extending downwardly from each of the pins 165 is a conductor 167 which is molded inside the insulating body of the cap 38. The four conductors 167 extend to a common vertical level where they terminate in four rounded conductor ends 168, which penetrate and protrude slightly beyond the inner cylindrical surface of cap 38. The four conductor ends 168 are aligned radially with the four pins 165 from which the four conductors 167 extend.

In the same manner, four conductors 167' extend downwardly from the alternate pins 165' and terminate in conductor ends 168' at a second vertical level spaced below the level at which the ends 168 were located. The conductor ends 168' are aligned radially with the pins 165'.

The spider assembly 161, which is integral with the cap 38, comprises a central conductive shaft 171 on which are mounted an upper spider 172 and a lower spider 173. Each of the spiders 172 and 173 has four coplanar arms extending outwardly from a central hub 175 equally spaced ninety degrees apart. The top of the shaft 171 is molded into the center of the top wall of cap 38 and it extends vertically downwardly therefrom. The pin 163, which is integral with the shaft 171, extends vertically upwardly from its top end. The spiders 172 and 173 are rigidly attached to shaft 171, the shaft passing through the hubs 175 so that the axis of the shaft 171 is perpendicular to the planes of the spiders 172 and 173. Spider 172 is coplanar with conductor ends 168 and spider 173 is coplanar with conductor ends 168'. Spider 173 is angularly displaced forty-five degrees from spider 172.

Commutator cup of rotor 39 comprises a cylindrical cup 176 fixed to the top of a shaft 177, the shaft 177 being secured perpendicularly to the center of the bottom surface of the cup 176. The cup 176 extends upwardly inside cap 38 and is coaxial with cap 38 and with the shaft 171 of spider assembly 161. The vertical walls of cup 176 pass between the interior cylindircal surfaces of cap 38 and the ends of the arms of the spiders 172 and 173. Carried in the vertical walls of the cup 176 are two conductive inserts, 178 and 179. The inserts 178 nd 179 are rectangular bars oriented horizontally. They are mounted opposite each other at an angular displacement of 180 degrees. Insert 178 is mounted coplanar with spider 172 and insert 179 is mounted coplanar with spider 173. Also fixed and rigidly indexed to the shaft but not shown in FIG. 6 is the reluctor 21 of FIG. 1.

The angular relationships of the spiders 172 and 173, the conductor ends 168 and 168' and the inserts 178 and 179 are best shown in FIG. 6A. As indicated earlier, the positions and alignment of the spiders 172 and 173 with the conductor ends 168 and 168' are fixed as shown while the intervening cup 176 is rotated by the engine in the direction indicated by the arrow 181. The arms of the spiders 172 and 173 extend almost to the inner surface of the cup 176, there being just sufficient clearance allowed to permit the passage of the inserts 178 and 179 past the ends of the arms 174. Minimal clearance is also provided between the outer surfaces of the inserts 178 and 179 and the conductor ends 168 and 168'.

The cup 176 is rotated by means of shaft 177 at one-half engine speed carrying the inserts 178 and 179 through the gaps separating the tips of the spider arms from the conductor ends 168 and 168'. It will be noted that for each forty-five degree increment of rotation, one of the inserts 168 or 169 will pass between a conductor end and the tip of an arm. If this occurs simultaneously with the generation of a voltage pulse by ignition coil 27, the pulse will pass from shaft 171 through the aligned spider arm, insert 178 or 179 and conductor end, 168 or 168' jumping the gaps and thence through the embedded conductor 167 or 167' to the connected pin 165 or 165' and through the spark plug cable to the plug. Because it is necessary to advance or delay the spark relative to rotational position, the inserts 178 and 179 must have sufficient circumferential length to insure that a portion of its length is aligned with the conductor end for any adjustment of the spark position. This consideration dictates a circumferential length of about twenty degrees.

Considering now the sequential operation of the distributor 159 with reference again to FIG. 6A, it will be noted that the individual conductor ends 168 and 168' are identified by the Roman numerals I–VIII followed by one of the digits, 1–8. By this designation the firing order and the spark plug locations are shown, the Roman numerals indicating the firing order and the Arabic numeral the plug location. For this purpose, the odd numbers 1, 3, 5 and 7 identify the plug positions from front to rear on one side of a V-8 engine and the even numbers 2, 4, 6, 8 identify the plug positions from front to rear on the other side of the engine. Also shown in FIG. 6A is the center line of the engine, indicating the orientation of the distributor 159 relative to the two sides of the engine.

The firing order, as indicated by the Roman numerals, may be verified by examination of FIG. 6A. In the instant shown, the upper insert 178 is just leaving alignment between upper spider 172 arm and upper conductor end 168 which is identified by Roman numeral IV. As cup 176 continues to rotate in the direction of arrow 181, alignment will next occur between lower spider 173 arm and lower conductor end 168' with lower insert 179 and is identified by the Roman numeral V, etc. The spark plug identifiers 1–8 have been assigned to provide an order 3-6-5-7-2-1-8-4, or when this sequence is rearranged to start with number 1, we get 1-8-4-3-6-5-7-2, which is the firing order used by many V8 engines. It will be noted that when this is done the even plug location numbers all lie on one side of the engine centerline and the odd numbered plug numbers locations on the opposite side. This is advantageous since it permits the dressing of the spark plug cables without having to cross over the top of the distributor 159.

Should the direction of rotation of cup 176 be reversed, as is the case with some V8 engines. this same arrangement can be accomplished by merely re-orienting the distributor 159 relative to the engine centerline by 45 degrees.

The primary advantage of the distributor assembly 159, as shown in FIGS. 6 and 6A, is that its special construction provides ample clearance for the high voltage sparks generated by the disclosed ignition system 20 while requiring no increase in overall diameter relative to a conventional distributor. This advantage has been achieved by separating alternate gaps into the two vertical layers associated with the two spiders 172 and 173. In this connection, the vertical distance between the two levels must be adequate to prevent a high voltage breakdown between a conductor end 168 at one level and a conductor end 168' in the other level. The same kinds of considerations also dictate the other dimensions of the distributor 159. The design of a working model in accordance with the invention yields a distributor capable of handling in excess of 40 kilovolts which is no larger dimensionally than a conventional distributor which is desinged for a lower voltage.

The same orientation of spark plug cables, relative to the engine V's , as described above, may be accomplished by replacing the cup 176 and spiders 172 and 173 with a somewhat conventional rotor except having two arms 180° apart, one lining up with the lower conductor ends 168' and the other lining up with the upper conductor ends 168. Thus when lower secondary voltages are acceptable, this construction will be less costly.

A solid-state ignition system and a novel distributor design have thus been provided in accordance with the stated objects of the invention. Although but a single embodiment of the invention has been illustrated and described, it will be apparent to those skilled in the art that various changes and modifications may be made therein without departing from the spirit of the invention or from the scope of the appended claims.

What is claimed is:

1. An ignition system for producing high voltage pulses to initiate arcs across spark plug gaps of an internal combustion engine comprising:

a reluctor having as many arms as there are cylinders in the associated engine and driven thereby, a pickup coil wound on a magnetic core mounted adjacent said reluctor for producing a sequence of alternating voltage pulses, one pulse with the rotation of each reluctor arm past the end of said core, a pulse modifying circuit for shaping and displacing the alternating voltage received from said pickup coil and producing a positive voltage that reaches a threshold level, said threshold level occurring linearly earlier, with increased engine speed, as each reluctor arm approaches said pickup coil core, a run amplifier connected to receive the output from said pulse modifying circuit and initiating a first pulse at the instant said voltage threshold level from said pulse modifying circuit is reached, the instant of initiation of said first pulse occurring at a linearly increasing angle prior to lineup of a reluctor arm with the end of said core as a function of increased reluctor rotative speed, a timer connected to receive said first pulse from the run amplifier initiating simultaneously a second pulse upon initiation of said first pulse by said run amplifier, said timer output being terminated after an exact constant timed interval, said timed interval being equal to the time required for said reluctor arm to traverse said linearly increasing angle as the rotative speed increases so that the termination of the exact constant timed interval always occurs at the same position of a reluctor arm prior to its lining up with the end of said core at all engine speeds, a switching means connected to said timer for actuation thereof during the duration of said constant timed interval, an ignition coil comprising a magnetic core having a primary and secondary winding wound thereon, said primary winding comprising a few turns of flat strip conductive material and said secondary winding comprising a multiple of layers with each layer having a multiple of turns with the beginning turn of each layer always starting from the same end of the layer that the preceding layer started from and the ending turn of each layer being returned between layers with a few large spiral turns to the beginning of the preceding layer, and the high voltage output end of said secondary winding being connected in series with a diode which prevents current flow through the secondary winding when current is flowing in the primary winding, said switching means being connected in series with said primary winding across a source of voltage thereby initiating current flow through said primary winding at the instant the output of the pulse modifying circuit reaches the said threshold level and terminating said current flow at the same position of a reluctor arm prior to its lineup with said core at all engine speeds, said current flow through said primary winding being continuous during said constant timed interval and resulting in an averaged current magnitude having zero value at zero RPM then increasing linearly with increased speed.

2. The ignition system set forth in claim 1 in further combination with:

an ignition switch in a crank position rendering said timer ineffective during cranking and supplying voltage from said voltage source to a crank amplifier, said crank amplifier connected to an interrupter, means for connecting said first pulse to said crank amplifier, means for connecting said crank amplifier output to said interrupter to generate a series of pulses during the duration of the said first pulse, said series of pulses being connected to said switching means.

3. The ignition system set forth in claim 1 in further combination with:

a spark position adjuster circuit;

said spark position adjuster circuit being connected to a source of energizing voltage and further connected to receive said second pulses from said timer, said spark position adjuster circuit when actuated by said second pulse producing a voltage output the magnitude of which is linearly responsive to said reluctor and engine speed.

4. The ignition system set forth in claim 3 in further combination with:

means for modifying said voltage output, and means for transmitting said modified voltage output to said pulse modifying circuit to change the position of the arm of said reluctor when it initiates said first pulse.

5. The ignition system set forth in claim 4 in further combination with:

at least one sensor connected to said engine for controlling the operation of said spark position adjuster.

* * * * *